US010473436B2

(12) United States Patent
Pottinger

(10) Patent No.: US 10,473,436 B2
(45) Date of Patent: Nov. 12, 2019

(54) BLAST RESISTANT STATION FIXED BARRIER

(71) Applicant: Cubic Corporation, San Diego, CA (US)

(72) Inventor: Mark Pottinger, East Sussex (GB)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 16/183,938

(22) Filed: Nov. 8, 2018

(65) Prior Publication Data

US 2019/0137224 A1 May 9, 2019

Related U.S. Application Data

(60) Provisional application No. 62/583,397, filed on Nov. 8, 2017.

(51) Int. Cl.
*F41H 5/24* (2006.01)
*F41H 5/013* (2006.01)

(52) U.S. Cl.
CPC ..... *F41H 5/24* (2013.01); *F41H 5/013* (2013.01)

(58) Field of Classification Search
CPC ..... E01F 13/00
USPC ..... 49/141
See application file for complete search history.

(56) References Cited

U.S. PATENT DOCUMENTS 2,509,362 A * 5/1950 Miller ..... B60J 9/02 244/119
3,329,450 A * 7/1967 Current ..... E21B 33/1204 403/2
3,425,353 A * 2/1969 Halling ..... F42C 15/188 102/255
3,864,881 A * 2/1975 Wolf ..... E04B 1/343 52/1
4,183,695 A * 1/1980 Wilcox ..... E01F 13/02 116/63 R
4,656,793 A 4/1987 Fons
(Continued)

FOREIGN PATENT DOCUMENTS

EP 2623920 A2 8/2013
GB 2294276 A 4/1996
(Continued)

OTHER PUBLICATIONS

International Search Report and Written Opinion dated Jan. 16, 2019 for International Patent Application No. PCT/US2018/059746, all pages.

*Primary Examiner* — Reginald S Tillman, Jr.
(74) *Attorney, Agent, or Firm* — Kilpatrick Townsend & Stockton LLP

(57) ABSTRACT

A blast resistant barrier system includes a base, a support structure extending outward from the base, a protective barrier that is pivotally coupled with the support structure at a first point of the protective barrier, and a shear pin that is configured to couple a second point of the protective barrier to the support structure so as to constrain rotation of the protective barrier relative to the support structure. The shear pin is configured to shear upon a threshold amount of force being applied to a face of the protective barrier. Once the shear pin shears, the protective barrier is permitted to rotate relative to the support structure about the first point.

20 Claims, 11 Drawing Sheets

(56) References Cited

U.S. PATENT DOCUMENTS

| | | | | |
|---|---|---|---|---|
| 7,798,893 | B2 * | 9/2010 | Eijkelenberg | E05B 65/102 137/68.17 |
| 2007/0163189 | A1 | 7/2007 | Venegas | |
| 2012/0060436 | A1 | 3/2012 | Zimmer | |

FOREIGN PATENT DOCUMENTS

| | | | |
|---|---|---|---|
| WO | 2009-035637 | A1 | 3/2009 |
| WO | 2014-107245 | A1 | 7/2014 |
| WO | 2015-053760 | A1 | 4/2015 |

* cited by examiner

BLAST RESISTANT STATION FIXED BARRIER

CROSS-REFERENCES TO RELATED APPLICATIONS

This application claims the benefit of U.S. Provisional Application No. 62/583,397, entitled "BLAST RESISTANT STATION FIXED BARRIER," filed on Nov. 8, 2017, the entire contents of which is hereby incorporated by reference.

BACKGROUND OF THE INVENTION

In many barrier applications, safety regulations require such barriers to be configured to withstand blast forces of particular levels. Conventional barriers, such as portable barriers and/or those that are bolted or otherwise fastened to the ground, must have very large, heavy bases in order to withstand the required blast forces without being driven away and generating dangerous debris. Additionally, if such forces are encountered, conventional barriers tend to be irreparably damaged (or damaged beyond cost-efficient repair capabilities. Improvements in blast barriers are desired.

BRIEF SUMMARY OF THE INVENTION

Embodiments of the present invention provide blast resistant barriers that are often used in applications in which an area is divided by partitions. In some embodiments, such barriers need to be able to withstand predetermined blasts or forces in the unlikely event that an explosive device and/or other object causes heavy forces to impact the barrier. In the event of such an impact, the protective barriers described herein may be configured to fall away to prevent excessive damage to the primary components of the protective barriers. For example, a main panel may be configured to pivot or rotate about a portion of a support structure upon being impacting by a force that exceeds a predetermined threshold. In some embodiments, a disengageable coupling mechanism, such as a shear pin, may be used to couple a portion of the main panel with the support structure. When a force that exceeds the predetermined threshold impacts the main panel, forces may be transferred to the disengageable coupling mechanism, which may then transition to a disengaged state in which the main panel can deflect from the support structure (such as by pivoting and/or rotating about a portion of the support structure). This deflection helps the main panel remain intact and substantially undamaged from the impact force.

In one embodiment, a blast resistant queueing barrier system is provided. The blast resistant queueing barrier system may include a base and a support structure extending outward from the base. The blast resistant queueing barrier system may also include a protective barrier that is pivotally coupled with the support structure at a first point of the protective barrier a shear pin that is configured to couple a second point of the protective barrier to the support structure so as to constrain rotation of the protective barrier relative to the support structure. The shear pin may be configured to shear upon a threshold amount of force being applied to a face of the protective barrier. Once the shear pin shears, the protective barrier may be permitted to rotate relative to the support structure about the first point.

In another embodiment, a blast resistant queueing barrier system may include a support structure and a protective barrier that is pivotally coupled with the support structure at a first point of the protective barrier. The blast resistant queueing barrier system may also include a disengageable coupling mechanism couples a second point of the protective barrier to the support structure so as to constrain rotation of the protective barrier relative to the support structure. The disengageable coupling mechanism may be configured to disengage upon a threshold amount of force being applied to a face of the protective barrier. Once the disengageable coupling mechanism disengages, the protective barrier may be permitted to rotate relative to the support structure about the first point.

In another embodiment, a method of using a blast resistant queueing barrier system is provided. The method of using a blast resistant queueing barrier system may include pivotally coupling a first point of a protective barrier with a support structure and engaging a disengageable coupling mechanism with a second point of protective barrier and the support structure to constrain rotation of the protective barrier relative to the support structure. The disengageable coupling mechanism may be configured to disengage upon a threshold amount of force being applied to a face of the protective barrier. Once the disengageable coupling mechanism disengages, the protective barrier may be permitted to rotate relative to the support structure about the first point.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

Figure 1A:
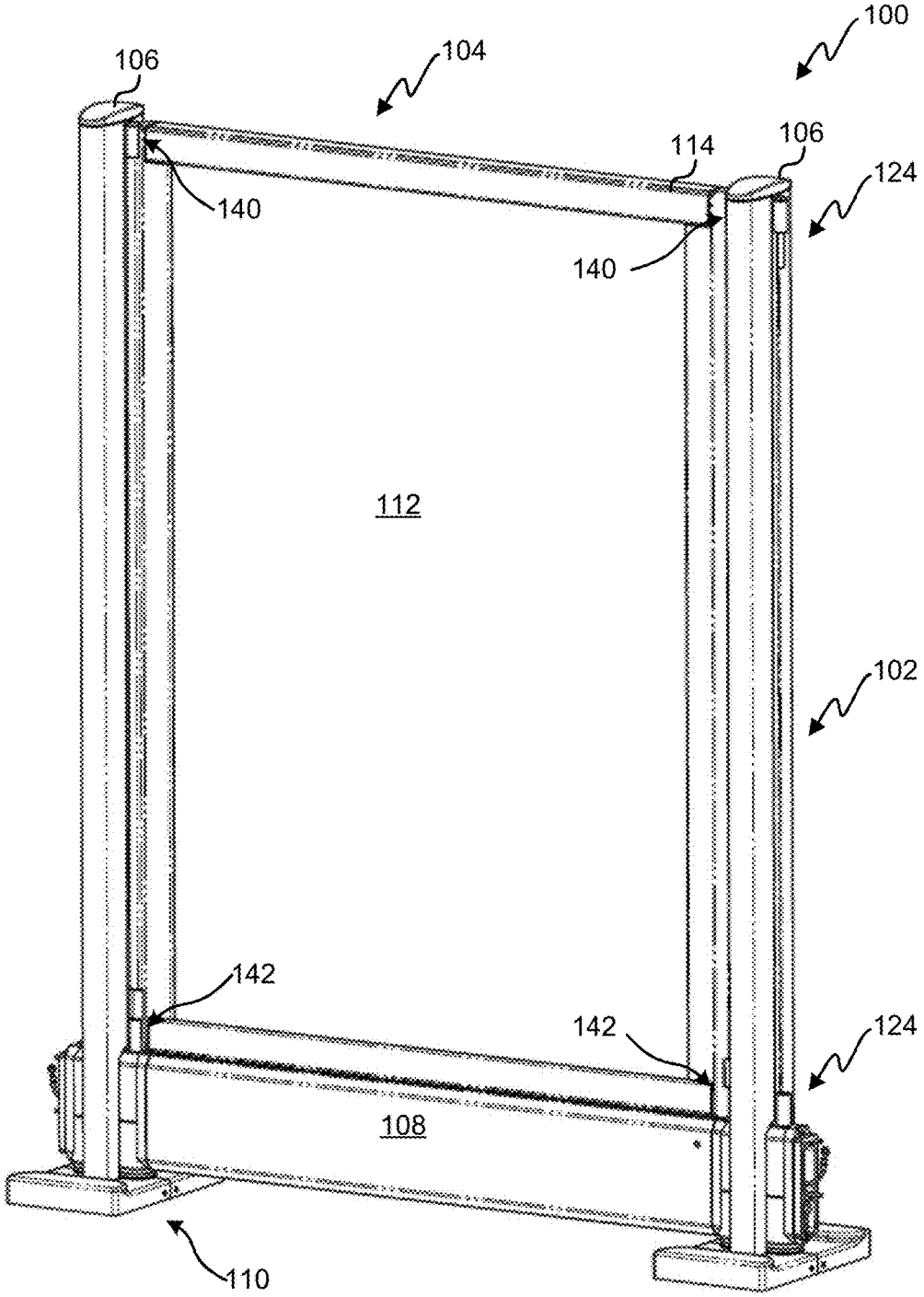
FIG. 1A depicts a blast resistant barrier according to embodiments.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention(s) described herein are generally related to a barrier system that is resistant to pre-defined blast criteria and will fail in a safe and controlled manner. For example, the barriers described herein may be designed to withstand a crowd barrier load (forces applied by crowds of people pushing against the barrier, oftentimes around 3.0 kN/m) while failing under loads of higher levels. For example, in one particular embodiment, the barriers may be configured to collapse/rotate when a load of 2.025 kN is applied to each of two shear pins used to secure a barrier in an upright position. It will be appreciated that the load demands of the barriers may be tailored to meet the needs of a particular application, and the load needed to shear each shear pins or other mechanisms may be dependent on the load limits and/or the number of shear pins used. The barriers may be used in transit and other applications in which blast resistant barriers are desired. For example, these barriers may be used to define queues and/or to separate public areas from access controlled areas, such as areas directly adjacent train tracks as just one example. A person of ordinary skill in the art will understand that alternative embodiments may vary from the embodiments discussed herein, and alternative applications may exist (e.g., in stadiums, museums, libraries, and similar venues. Additional applications may include barrier systems in "risk" locations, signage systems located in "risk" locations, crowd-control barriers, highway emergency breakthrough barriers, etc.

In some embodiments, the blast resistant barriers may include a support structure that is coupled with a main panel or protective barrier. In some embodiments, the support structure may be mounted on a base that allows the entire blast resistant barrier to be moveable, while in other embodiments the support structure may be affixed to a wall structure and/or ground structure and may thus have a fixed position. The protective barrier may be pivotally mounted on the support structure, with a disengageable coupling mechanism, such as a shear pin, being used to constrain the pivoting and/or rotation of the protective barrier when engaged. The disengageable coupling mechanism may be disengaged upon the protective barrier being impacted with a force, such as a force from an explosive blast, that is above a threshold level. Once the disengageable coupling mechanism is disengaged, the protective barrier may be permitted to rotate and/or pivot about a portion of the support structure. This rotation helps preserve the integrity of the protective panel when impact forces that exceed the threshold level would otherwise damage the same barrier if maintained in a fixed orientation.

Embodiments of the present invention provide numerous benefits over rigid barriers. For example, when in a neutral state (i.e., when not subjected to loads that exceed the threshold level), the blast resistant barriers describe herein may remain in a desired location to wall off areas and/or define queueing paths. When subjected to loads exceeding the threshold, the rotation of the protective barrier ensures that the protective barrier itself is still able to remain intact and will remain attached to the support structure. Embodiments of the present invention also allow the footprint of the support structure and/or base of the blast resistant barrier to be greatly reduced compared to a rigid barrier design where the panel remains fixed in a single orientation relative to the support structure, as such fixed embodiments require a much stronger base/support structure to support the panel upon application of large impact forces.

Turning now to FIG. 1A, one embodiment of a blast resistant barrier 100 is illustrated. The blast resistant barrier 100 includes a support structure 102 that is coupled with a protective barrier 104. As illustrated, support structure 102 includes a pair of vertical posts 106 that are positioned on either side of the protective barrier 104 and a crossbeam 108 that is positioned below the protective barrier 104 and coupled with each of the vertical posts 106. In some embodiments, the support structure 102 may also include a top crossbeam 108 that may be positioned above the protective barrier 104 that may provide additional rigidity to the posts 106. In some embodiments, rather than having both a top crossbeam and crossbeam 108, only a top crossbeam may be used. In yet other embodiments, support structure 102 may include no crossbeams and may just have posts 106 that are positioned one either side of the protective barrier 104. In yet other embodiments, support structure 102 may include only a single post 106 and/or only crossbeam 108, with the protective barrier 104 being coupled with the single component of the support structure 102.

It will be appreciated that support structure 102 may take many different forms and may involve any number of horizontal and/or vertical components that may combine to support one or more protective barriers 104. While shown here with a generally rectangular shape, it will be appreciated that in some embodiments, the support structure 102 may be in a non-rectangular shape so as to support a non-rectangular protective barrier 104.

In some embodiments, the support structure 102 may be coupled with a base 110, which may include feet that stabilize the blast resistant barrier 100 and allow the blast resistant barrier 100 to be movable to any desired location. In such embodiments, the base 110 and/or support structure 102 may be formed from heavy materials, such as various metals such as aluminum or steel, and/or metal alloys such that the blast resistance barrier 100 can remain stationary when subjected to most forces. In some embodiments, base 110 may be secured to the ground and/or walls using one or more fastening mechanisms. For example, the base 110 may be bolted, clamped, suctioned, and/or otherwise affixed to a ground and/or wall structure to further prevent the blast resistant barrier 100 from moving once in a desired position. In other embodiments, the support structure 102 may be mounted to a wall and/or ground structure (without a base) to fix the blast resistant barrier 100 at a particular location.

Oftentimes, the components of the support structure 102 and/or base 110 may be thicker and/or heavier than the protective barrier 104, while having a smaller area than a main face of the protective barrier 104. This allows the support structure 102 and/or base 110 to have a very high strength to area ratio to remain intact when subjected to high impact forces. The thinner protective barrier 104 allows a significant portion of the blast resistant barrier 100 to be Protective barrier 104 may be formed from one or more pieces of strong, protective material. For example, protective barrier 104 is often formed from blast-resistant glass, plastic, and/or metal. In some embodiments, the protective barrier 104 may be in the form of a generally flat panel 112, which, in some embodiments may be surrounded by a frame 114 on one or all sides of the panel 112. In other embodiments, the protective barrier 104 may be a single unframed panel. Oftentimes, protective barrier 104 may make up a substantial portion of the face of a blast resistant barrier 100, but may be significantly thinner than some or all of the support structure 102. This sizing helps reduce the weight of the blast resistant barrier 100, as well as reduces the amount of materials needed to construct each blast resistant barrier 100. Additionally, by making the protective barrier 104 lighter than the support structure 102, the support structure 102 may be able to withstand the forces and remain in the desired position despite the momentum created by any rotation of the protective barrier 104 during a blast event. The panel 112 may be formed to any desired thickness, height, and/or width, with the size and weight of the panel 112 contributing to its ability to resist impact forces, which may change a disengagement force for any disengageable coupling mechanisms utilized.

The protective barrier 104 may be pivotally and/or rotatably coupled with the support structure 102 at or near one end of the protective barrier 104. As illustrated in FIG. 1A, the pivotal coupling 142 between the protective barrier 104 and the support structure 102 is at a lower end of the protective barrier 104 (although any end/edge of the protective barrier 104 may be used to pivotally couple the protective barrier 104 with the support structure 102). Such positioning enables the protective barrier 104 to pivot downward, such that the protective barrier 104 is parallel (or substantially parallel) to the ground, with a top of the protective barrier 104 being positioned near (above or below) or at an equal height as the bottom of the protective barrier 104. In some embodiments, the top edge of the protective barrier 104 may be pivoted so far that the top edge contacts the ground and the protective barrier slopes downward from the bottom edge to the top edge.

Figure 1B:
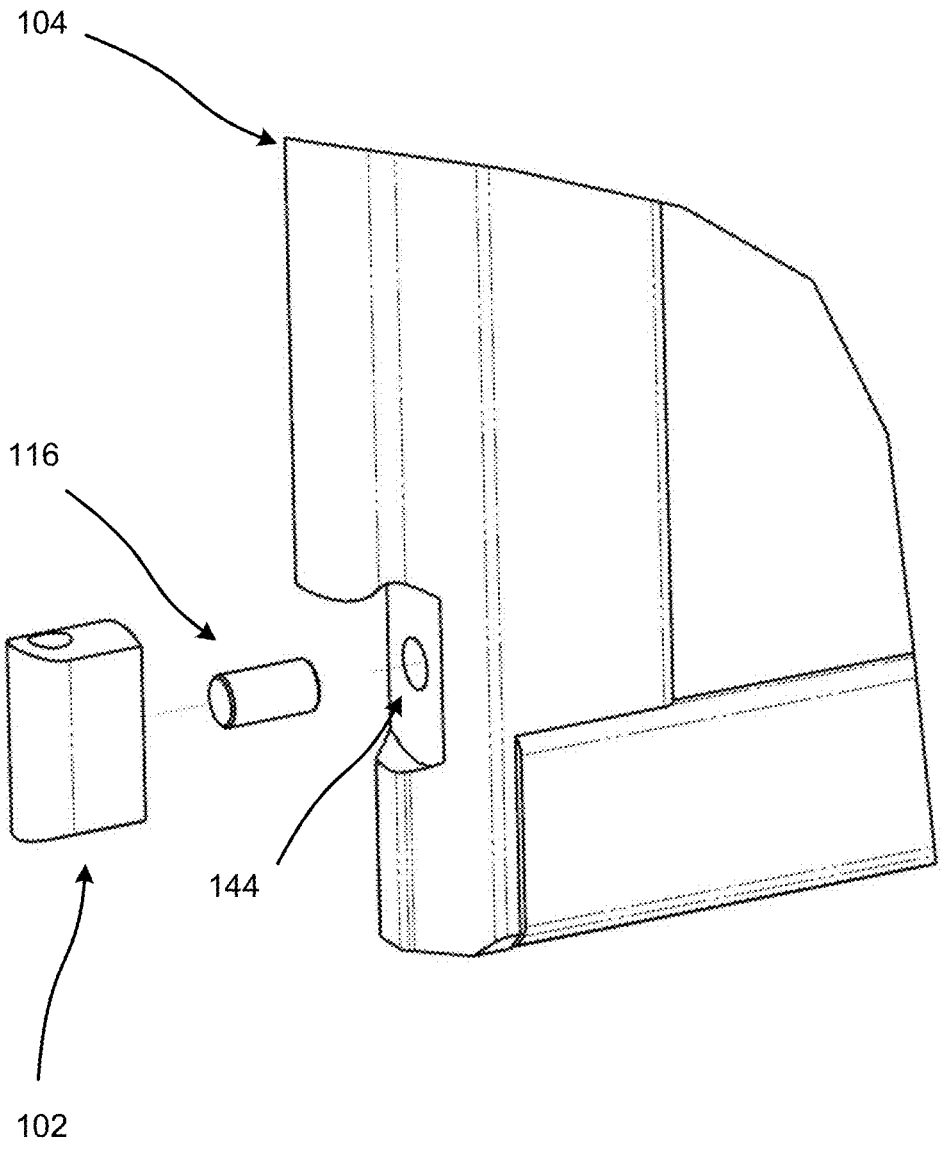
FIG. 1B depicts a pivotal connection of the blast resistant barrier of FIG. 1A.

The pivotal connection 142 may be provided in any number of ways. For example, as shown in FIG. 1B, a pinned connection may be used to pivotally secure the protective barrier 104 to the support structure 102. Here, each of the protective barrier 104 and the support structure 102 may define apertures or recesses 114 that are sized to receive an end of a pin 116. For example, each side of the support structure 102 may define a recess 114 in an interior side of the support structure 102 (such as an interior region of each post 106), while opposing outer edges of the protective barrier 104 may define a recess 144, thereby providing a channel within with each pin 116 may be received to couple each side of the protective barrier 104 with a respective interior side of the support structure 102. Once each side of the protective barrier 104 is mounted on the pin 116, the protective barrier 104 may rotate about the pins 116 on either side of the protective barrier 104.

In some embodiments, rather than using a pinned connection as shown in FIG. 1B, other rotatable connections may be used to couple the end of the protective barrier 104 to the support structure 102. For example, a single rod may extend through all or part of a width of the protective barrier 104, with one or both ends of the rod being rotatably mounted within the support structure 102. In other embodiments, hinges and/or other rotatable connections may be used to pivotally couple the protective barrier 104 to the support structure 102.

While shown with the bottom edge of the protective barrier 104 being pivotally coupled with interior sides of the support structure 102, it will be appreciated that the protective barrier 104 may be pivotally coupled with the support structure 102 in other manners. For example, a bottom of the protective barrier 104 may be pivotally secured to the support structure 102 using pins and/or rods as described above. In such embodiments, the protective barrier 104 may be configured to pivot horizontally, rather than vertically, about the hinged connection and/or a post 106 of the support structure 102. As another example, the protective barrier 104 may be pivotally coupled about a top crossbeam of the support structure 102. In such embodiments, the protective barrier 102 may be configured to pivot upward in a vertical direction about the top crossbeam. Any number of possible combinations of mounting positions and/or pivotal connection types may be used in accordance with the present invention.

Figure 1C:
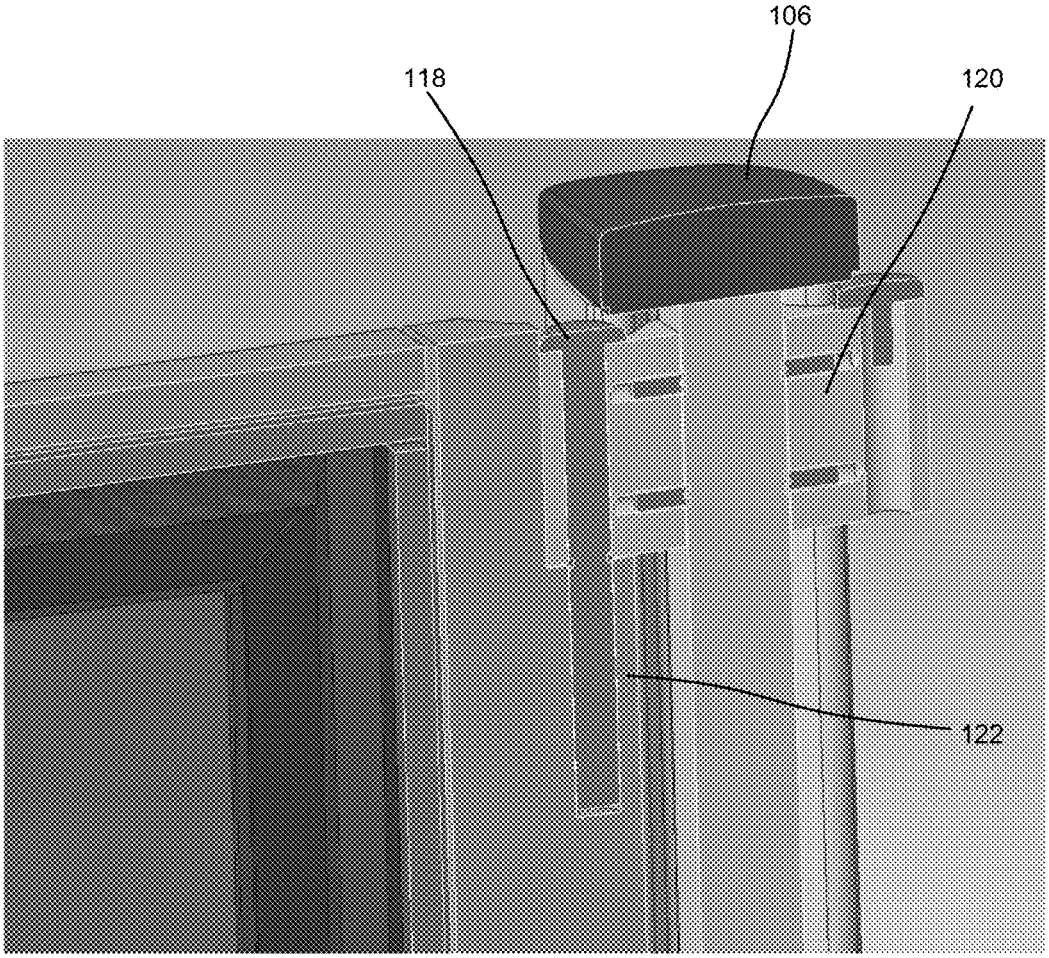
FIG. 1C depicts a shear pin connection of the blast resistant barrier of FIG. 1A

To keep the protective barrier 104 in a default barrier position (i.e. to prevent the protective barrier 104 from pivoting all the time), an additional coupling may be made between the protective barrier 104 and the support structure 102. The additional coupling may be positioned at any location relative to the pivotal coupling and, when engaged, acts to constrain the rotation of the protective barrier 104 relative to the support structure 102. The additional coupling mechanism may be a disengageable coupling mechanism 140 that is configured to remain engaged until a threshold level of force is applied to the disengageable coupling mechanism 140 and/or the protective barrier 104. In some embodiments, the disengageable coupling mechanism 140 may be a shear pin 118 that may be coupled to both the protective barrier 104 and the support structure 102. As just one example, a surface of the support structure 102 (such as a side surface of one or more of the posts 106) may include a pin holder 120, which may extend outward from at least a portion of the surface of the support structure 102 and may define a channel that may be configured to receive a portion of a shear pin 118 as shown in FIG. 1C. The protective barrier 104 may define a similar channel in an outer edge 122 that receives another portion of the shear pin 118. As illustrated, the pin holder 120 defines a vertically oriented channel, which may be aligned with a corresponding channel formed in a side surface, outer edge, and/or protrusion formed in the protective barrier 104. For example, the protective barrier 104 may include a portion that is similar to pin holder 120 that may extend outward from a surface of the protective barrier 104 and that defines a second channel for receiving the shear pin 118. The shear pin 118 may be inserted within both the channel in the pin holder 120 and the channel defined by the protective barrier 104 such that the shear pin 118 can constrain rotation of the protective barrier 104 relative to the support structure 102. The shear pin 118 may be configured to shear upon being impacted by a force that exceeds a particular threshold. The use of vertically (or substantially vertical) oriented channels allows gravity to help maintain the shear pin 118 at a desired depth, which may be particularly useful as the shear pin may be configured to shear at a specific location.

For example, in some embodiments, the shear pin 118 may be configured to shear at a point that is at or proximate a joint of the pin holder 120 and the outer edge 122 of the protective barrier 104. Such shear pin designs are described in further detail in relation to FIG. 2 below. These designs of shear pin 118 ensure that then shear pin 118 breaks, the shear pin 118 will not obstruct or otherwise interfere with the rotation of the protective barrier 104. Such a design of a shear pin 118, pin holder 120, and outer edge 122 enable the protective barrier 104 to be pivoted other otherwise rotated in either direction once the shear pin 118 is disengaged/sheared.

It will be appreciated that other arrangements of shear pin 118 may be utilized, with or without pin holder 120. In some embodiments, For example, in some embodiments, a shear pin 118 may be inserted in a generally horizontal manner through a channel that extends entirely though a thickness of a portion of the support structure 102 and into an additional channel formed laterally into a side of the protective barrier 104. This allows the shear pin 118 to be inserted into the protective barrier 104 and the support structure 102 from an outside edge of the support structure 102. Numerous other designs are also possible in accordance with the present invention. While illustrated with the shear pins 118 and the pin 116 being oriented along different axes, it will be appreciated that in some embodiments, the shear pin 118 and pins 116 may be oriented in the same direction and/or along a single axis.

In some embodiments, rather than using a shear pin 118, other disengageable coupling mechanisms may be used. For example, in some embodiments, a blast resistant barrier 100 may use a magnetic element (which may include permanent magnets and/or electromagnets) as a disengageable coupling mechanisms. For example, the support structure 102 and/or the protective barrier 104 may include a magnetic element that is spaced apart from the pivotal coupling. The magnetic element(s) may be selected to apply a magnetic force that secures the protective barrier 104 at a fixed position relative to the support structure 102 until an impact having a force that exceeds the threshold. In some embodiments, the magnetic element(s) may be positioned on respective edges of the protective barrier 104 and the support structure 102 that face one another such that when engaged with one another, an inward face of a magnetic element (or other ferromagnetic material) on the support structure 102 contacts (or nearly contacts) an outward face of a magnetic element (or other ferromagnetic material). Such configurations allow the protective barrier 104 to be pivoted other otherwise rotated in either direction once the magnetic element(s) are disengaged from one another by a large impact force acting upon the protective barrier 104.

In other embodiments, one or both of the protective barrier 104 and the support structure 102 may include one or more protruding tabs that create an obstruction of movement of the protective barrier 104 relative to the support structure 102 when the protective barrier 104 is in a default/barrier position. The tabs and/or surfaces contacting the tabs may include magnetic elements that can secure the protective barrier 104 is the default/barrier position. When the protective barrier 104 is impacts by a force that exceeds the threshold level, the magnetic elements may be disengaged from one another (or other surface) and the protective barrier 104 is permitted to rotate about the support structure 102. In such embodiments, rotation of the protective barrier 104 may be permitted in only one direction, as the tabs will obstruct rotation in the other direction.

Yet other forms of disengageable coupling mechanisms may be utilized. For example, a snap-fit connection may be used in which the snap-fit connection is aligned with a direction of rotation of the protective barrier 104. The snap-fit connection may be designed to require a disengagement force that is at the threshold level such that when a force at or above the threshold level the snap-fit connection will disengage and allow the protective barrier 104 to rotate away from the direction of the force. In other embodiments, a spring-loaded ball and detent connector may be used. The spring force may be selected such that when a force at or exceeding the threshold level is applied to the protective barrier 104, the ball may be pushed against the spring sufficiently so as to disengage from the detent, which may allow the protective barrier 104 to rotate relative to the support structure 102. It will be appreciated that other disengageable mechanical couplings that have a customizable disengagement force may be used in accordance with the present invention, with both those mechanisms that permit bi-directional rotation and those that permit rotation in a single direction being possible.

Embodiments of the present invention may include any number of disengageable coupling mechanisms. As more disengageable coupling mechanisms are included on a single protective barrier 104, the disengagement force may be reduced such that the net impact force on the protective barrier 104 can disengage all of the disengageable coupling mechanisms upon the impact force being at or above the threshold level. For example, if two disengageable coupling mechanisms are used, each may have a disengagement force that is half of what would be necessary if a single disengageable coupling mechanism was used instead. In this manner, the threshold force may be held constant while still ensuring that all of the disengageable coupling mechanisms will properly disengage.

The disengageable coupling mechanisms may be positioned at any location along the protective barrier 104, as long as the placement of the disengageable coupling mechanisms has the effect of constraining rotation of the protective barrier 104. The disengagement force of each disengageable coupling mechanism may be selected based on a combination of the geometry/mass of the protective barrier 104, the position of the disengageable coupling mechanism, the threshold force, the materials of the protective barrier 104, number of disengageable coupling mechanisms used, and/or other factors. For example, disengageable coupling mechanisms positioned near a top edge of the protective barrier 104 may have a different disengagement force than disengageable coupling mechanisms disengageable coupling mechanisms positioned near a medial portion of the protective barrier 104. Larger protective barriers 104 may utilize disengageable coupling mechanisms having different disengagement forces that smaller protective barriers 104. It will be appreciated that the disengageable coupling mechanisms described herein may be carefully tailored to a particular application based on any combination of the above and/or other factors to ensure that the disengageable coupling mechanisms disengage at the right level of force.

In some embodiments, blast resistant barrier 100 may include an additional coupling position 124 for one or more additional protective barriers 104. Additional coupling positions 124 may include additional pivotal couplings and additional disengageable coupling mechanisms (or places for disengageable coupling mechanisms to be interfaced). As illustrated in FIG. 1A, additional coupling position 124 is positioned on an opposite side of the post 106, such that an additional protective barrier 104 may be coupled to the post 106 in a side by side arrangement with the protective barrier 104 shown. Such use of an additional It will be appreciated that in some embodiments, additional and/or different additional coupling positions 124 may be provided on other sides of the post 106 (or other component of a support structure 102). For example, additional coupling positions 124 may be placed every 45 degrees, every 90 degrees, every 180 degrees, and/or other intervals. Such arrangements allow for any number of protective barriers 104 to be coupled together using any number of support structures 102 in a daisy chain manner to create an elongated blast resistant partition, which may or may not include angled connections to form corners of the partition.

After the protective barrier 104 is impacted by a force exceeding the threshold level, some or all of the force is transferred to the disengageable coupling mechanisms, which then disengage. The force also causes the protective barrier 104 to begin to rotate about the pivotal connection.

Figure 1D:
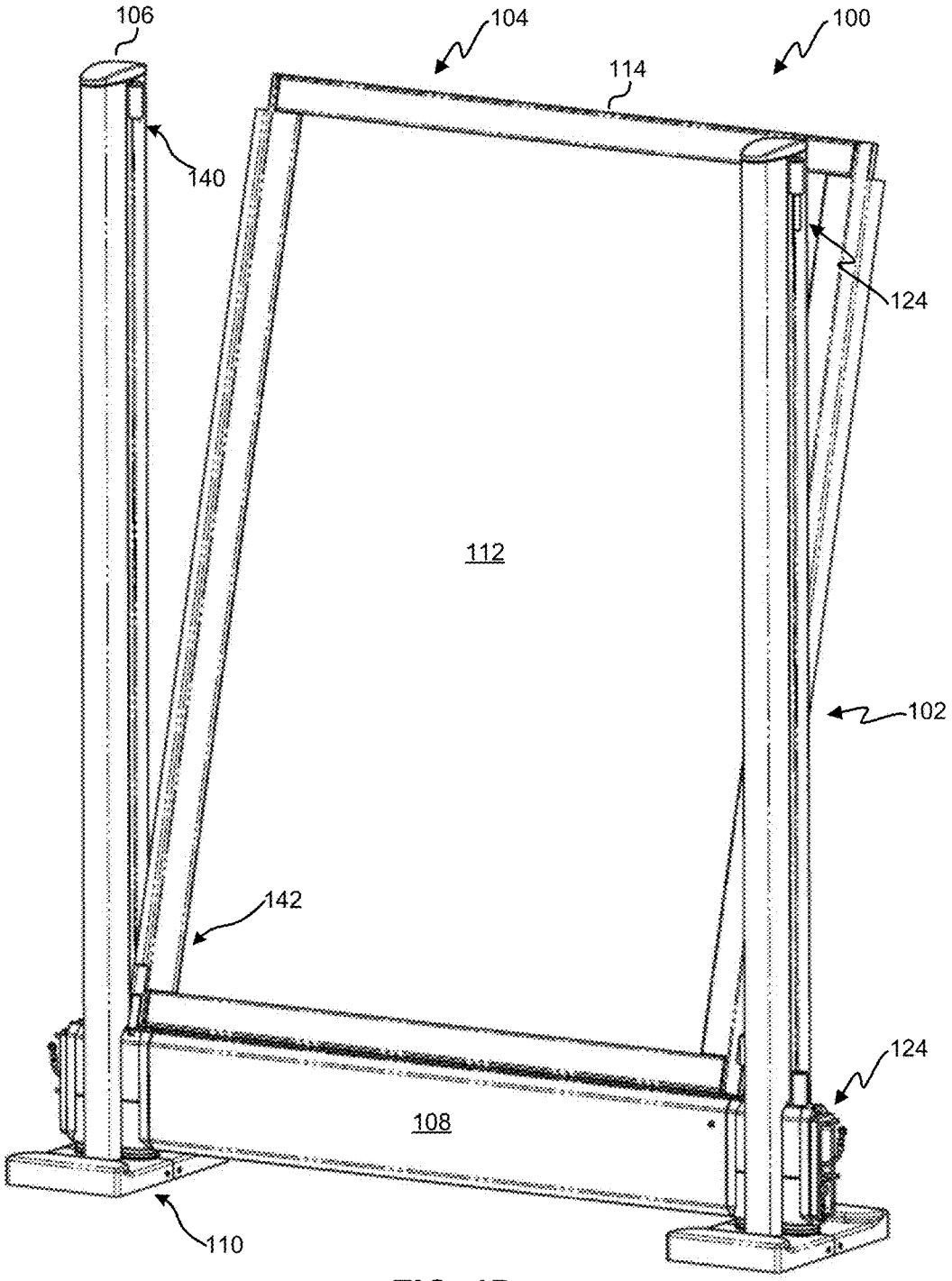
FIG. 1D depicts the blast resistant barrier of FIG. 1A at an intermediate blast position according to embodiments.
Figure 1E:
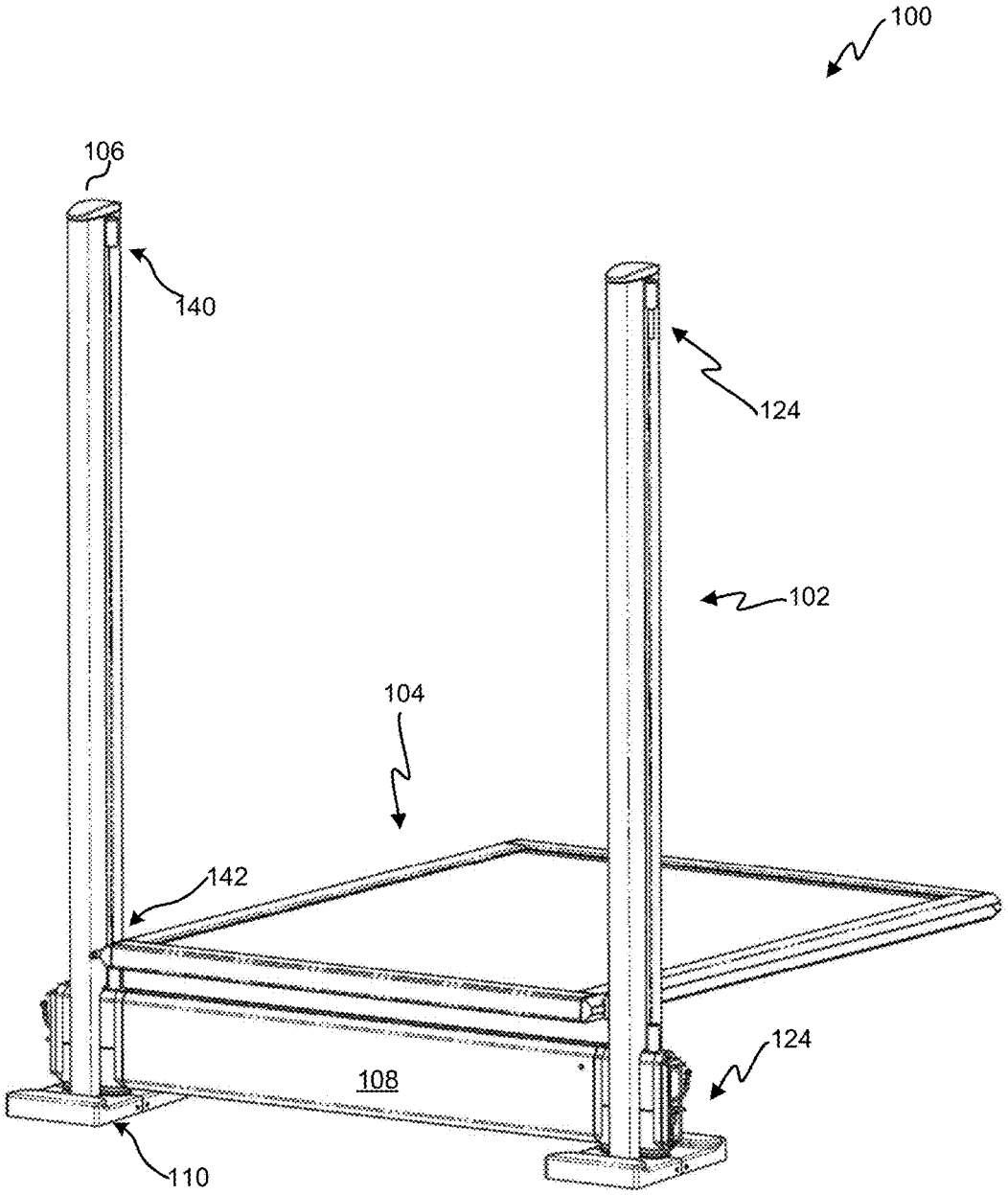
FIG. 1E depicts the blast resistant barrier of FIG. 1A at a final blast position according to embodiment.

For example, FIG. 1D depicts the protective barrier 104 at an intermediate rotational position after the disengageable coupling mechanisms have been disengaged. Here, the protective barrier 104 has partially rotated about the pins 116 at the lower end of the protective barrier 104. The protective barrier 104 may continue to rotate until it is fully folded as shown in FIG. 1E. While shown here with protective barrier 104 being in a generally horizontal position when fully folded, it will be appreciated that the range of rotation of protective barrier 104 may be greater or less than shown. For example, in the fully folded position, the protective barrier 104 may slope downward from the bottom edge to the top edge. At a later time, the protective barrier 104 may be rotated back up into the default/barrier position depicted in FIG. 1A. At this time, the disengageable coupling mechanism(s) may be reset. For example, when shear pins 118 are used, the broken shear pins 118 may be removed and new shear pins 118 may be inserted into channels formed in the protective barrier 104 and the support structure 102. In other embodiments, magnetic elements, snap-fit connectors, and/or other disengageable coupling mechanisms may be re-engaged to prevent rotation of the protective barrier 104 until application of another force exceeding the threshold level.

Figure 2:
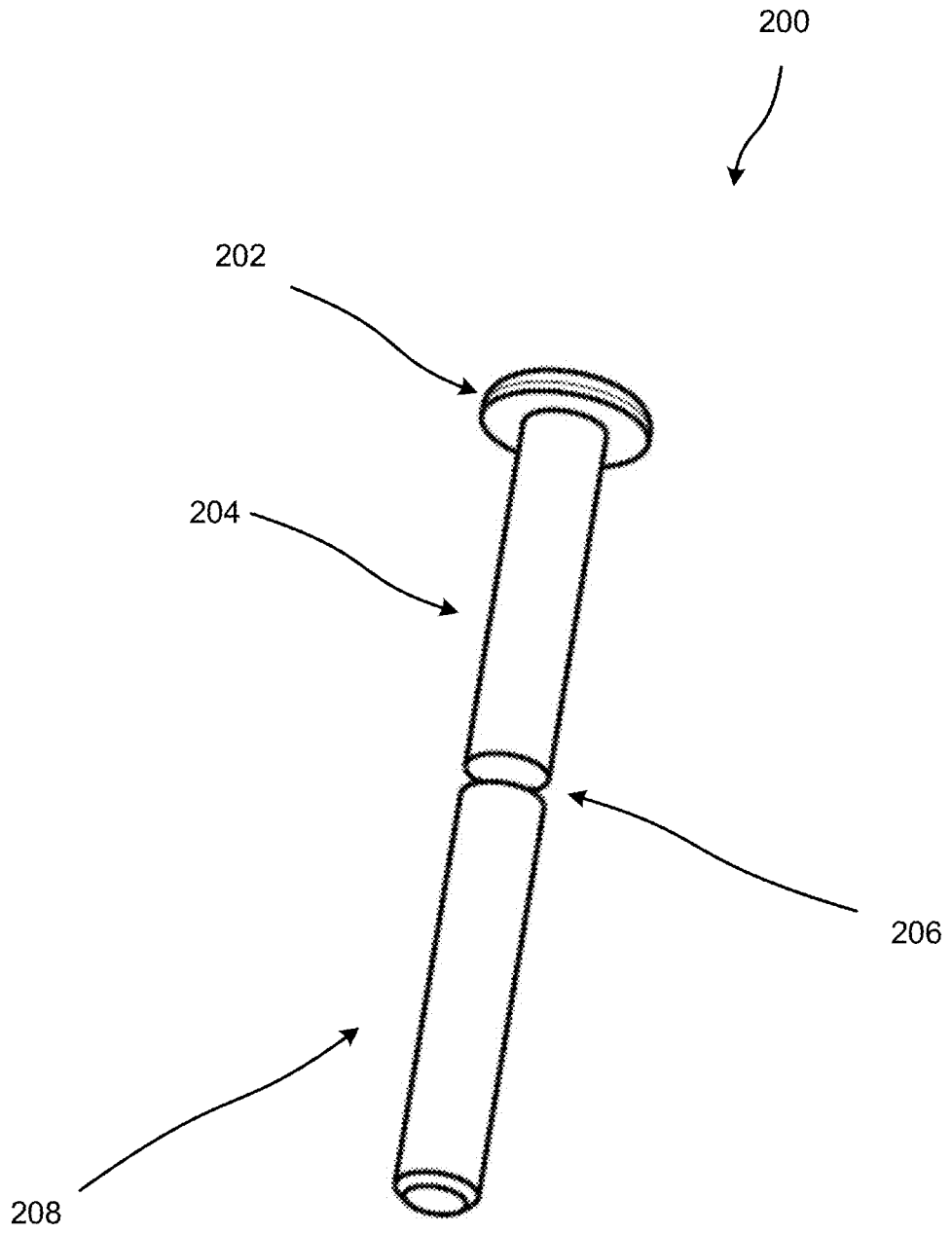
FIG. 2 depicts a shear pin according to embodiments.

FIG. 2 depicts one embodiment of a shear pin 200 that may be used as a disengageable coupling mechanism in accordance with the present invention. Shear pin 200 may be the same as shear pin 118. Shear pin 200 may be formed of a metal, such as brass or steel, although any material may be used that can be designed to be a sufficiently small size while still having the required shear strength to serve as a disengageable coupling mechanism as described herein. As illustrated, shear pin 200 includes a head 202, a first portion 204, a frangible portion 206, and a second portion 208. The head 202 may be used to limit the insertion depth of the shear pin 200 within the support structure and/or the protective barrier to ensure that the shear pin is properly positioned to break in the desired location to permit rotation between the support structure and the protective barrier. In some embodiments, the shear pin 200 may not include a head 202, and the entire shear pin 200 may be inserted within the support structure and/or protective barrier.

Oftentimes the first portion 204 and the second portion 208 have the same diameter, while the frangible portion 206 has a smaller diameter. Such designs help ensure that the shear pin 200 fails at a desired location (the frangible portion 206) so as to enable free rotation of the protective barrier once the shear pin 200 fails.

In some embodiments, the frangible portion 206 may have a single diameter, while in other embodiments the diameter will gradually taper from a diameter of the first portion 204 and second portion 208 to a smallest diameter of the frangible portion 206. The smallest diameter may be selected based on the material of the shear pin 200 and the desired shear force to achieve the desired failure upon an impact force equal to or greater than the threshold level impacting the protective barrier. The smallest diameter of the frangible portion 206 is designed to serve as the shear point of the shear pin 200. Such a design allows the shear pin 200 to be inserted into the support structure and the protective barrier in a manner such that the smallest diameter of the frangible portion 206 is aligned with the juncture between the support structure and the protective barrier such that when the shear pin 200 fails, no intact portion of the shear pin 200 obstructs relative movement between the support structure and the protective barrier.

In some embodiments, other forms of shear pins may be used. For example, single-thickness shear pins and/or split pins may be used. Any shear pin design that allows the pin to fail at the desired location to permit rotation between the support structure and the protective barrier may be used in accordance with the present invention.

Figure 3:
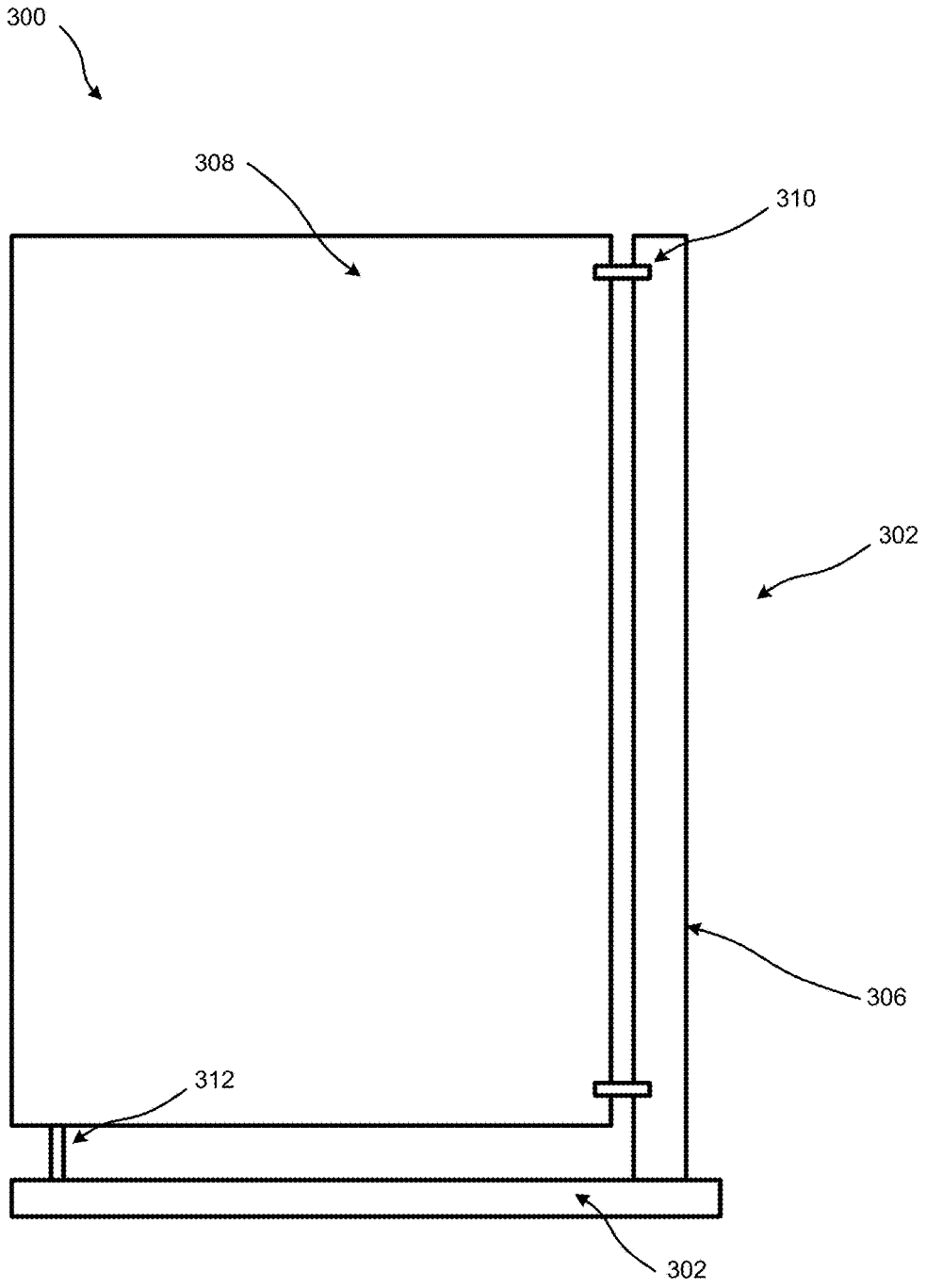
FIG. 3 depicts a blast resistant barrier according to embodiments.

FIG. 3 depicts another embodiment of a blast resistant barrier 300. Here, blast resistant barrier 300 includes a support structure 302 that is mounted to a base 304. As illustrated, support structure 302 includes a single post 306 (although multiple posts 306 may be used) that extends upward from the base 304 and supports a protective barrier 308 (which may be similar to protective barrier 104). A pivotal connection 310, such as a rotatable pin, rod, hinge, and/or other rotatable connection may be used to couple the protective barrier 308 with the base 304 and/or support structure 302 in a manner that allows the protective barrier 308 to rotate in a generally horizontal direction about the post 306. As just one example, a shear pin (not shown) and/or other disengageable coupling mechanism 312 may be inserted through the protective barrier 308 and one or both of the base 304 and/or post 306 to constrain rotation of the protective barrier 308 until the protective barrier 308 is impacted by a force exceeding the threshold level.

Figure 4:
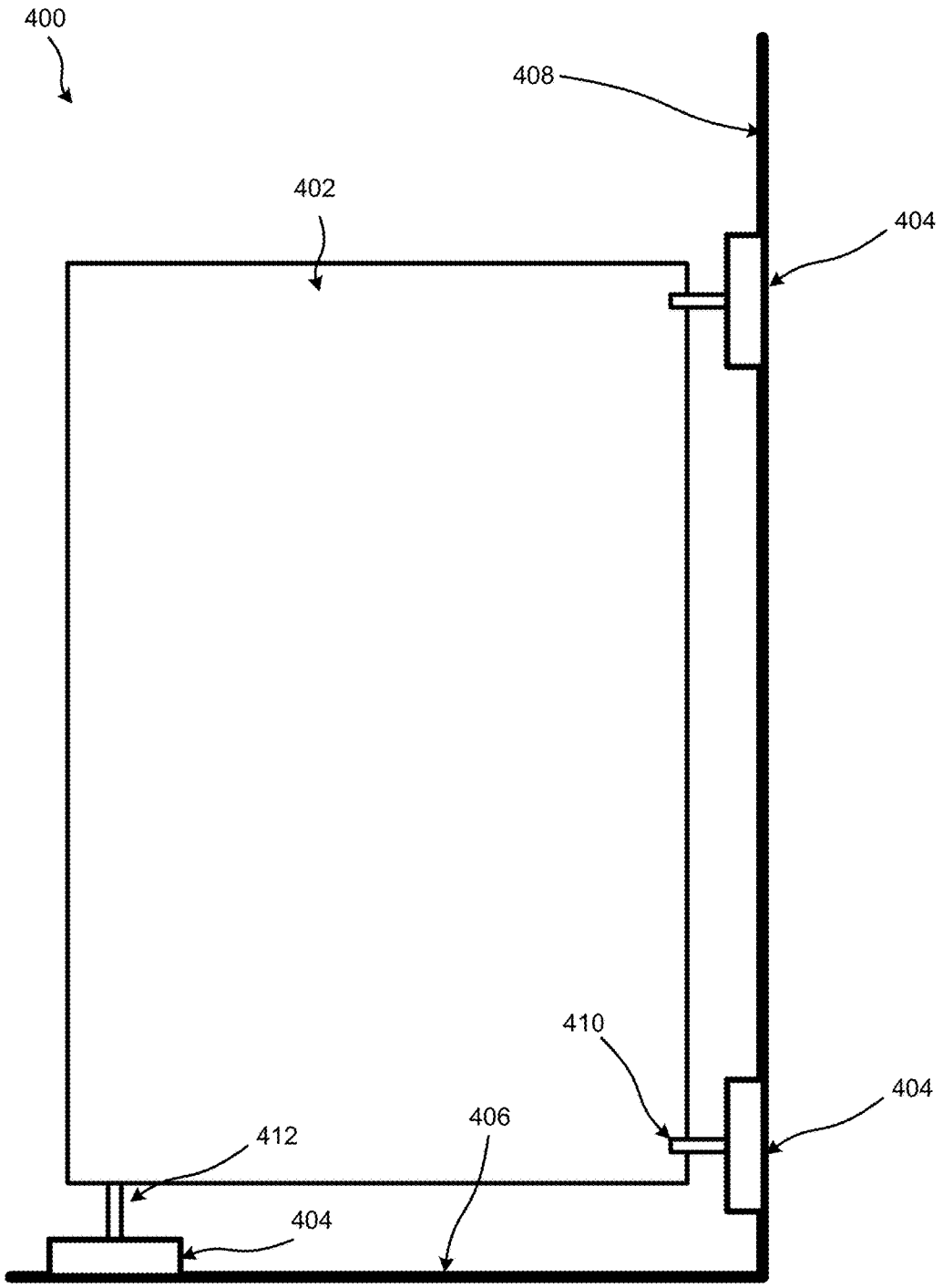
FIG. 4 depicts a blast resistant barrier according to embodiments.

FIG. 4 illustrates an embodiment of a blast resistant barrier 400 that does not include a base. Rather, blast resistant barrier 400 include a protective barrier 402 that is mounted to a support structure 404 that couples the protective barrier 402 to a ground structure 406 and/or wall structure 408. The support structure 404 may be a frame, bracket, and/or other member that provides a location for both a pivotal coupling 410 and a disengageable coupling mechanism 412 to be interfaced and to support the protective barrier 402. The support structure 404 may then be coupled with the ground structure 406 and/or wall structure 408 using one or more fasteners and/or by having a portion of the support structure 404 embedded within the structure 406 and/or wall structure 408. The protective barrier 402 may be configured to rotate in a vertical or a horizontal manner when impacted by a force exceeding the threshold level such that the protective barrier 402 may fold up to a position proximate the ground structure 406 or the wall structure 408.

Figure 5:
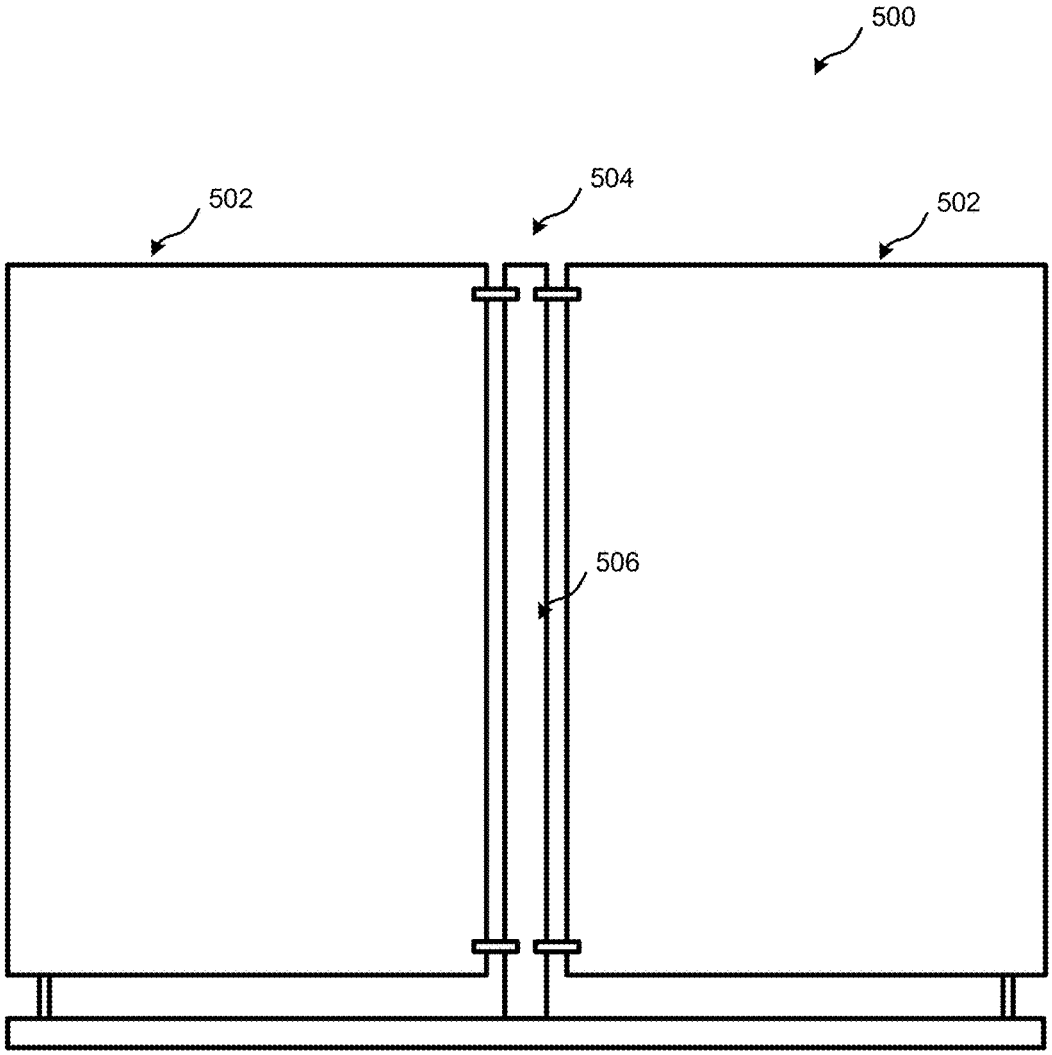
FIG. 5 depicts a blast resistant barrier according to embodiments.
Figure 6:
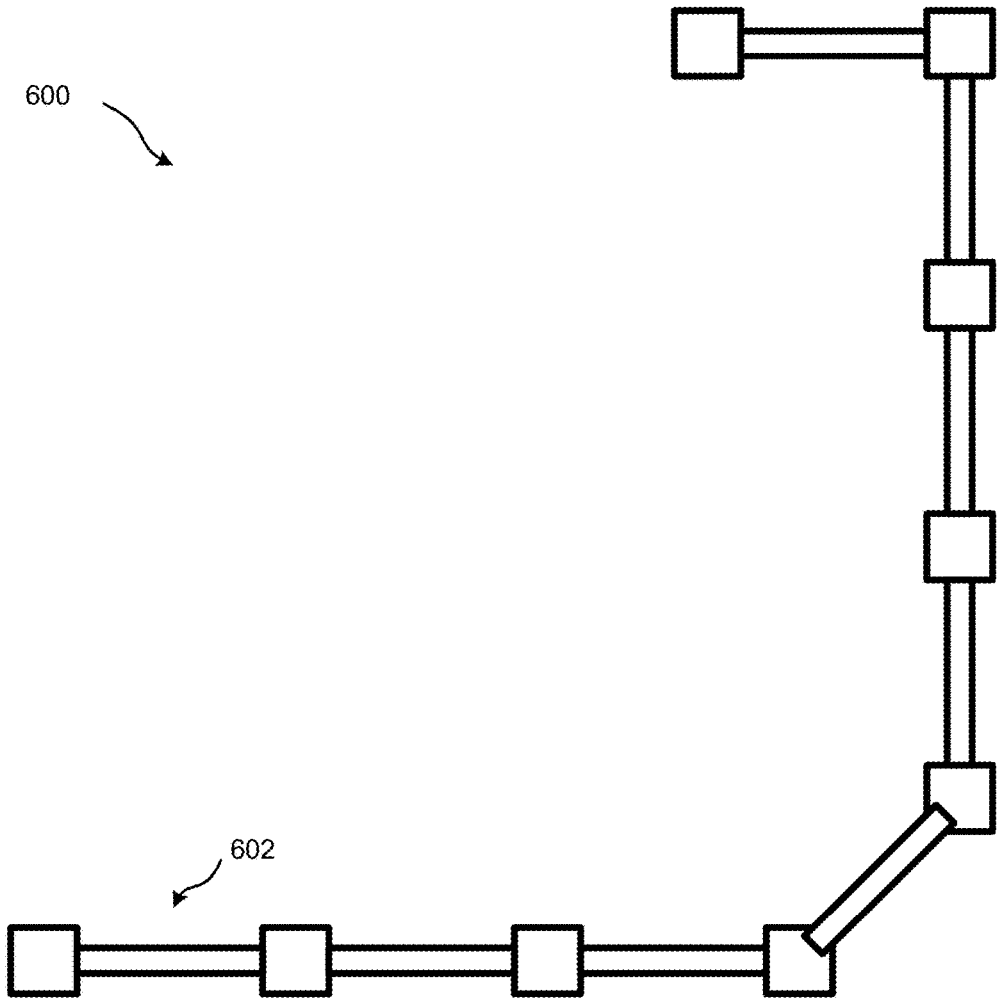
FIG. 6 depicts an elongated barrier system according to embodiments.

FIG. 5 illustrates an embodiment of a blast resistant barrier 500 that includes two protective barriers 502. Blast resistant barrier 500 may be similar to blast resistant barrier 100 described above, and may include a support structure 504 having one or more posts 506 that are each configured to support two protective barriers 502 in a side by side and/or angled arrangement. As illustrated here, a single post 506 supports two protective barriers 502 in a side by side arrangement. Blast resistant barrier 500 may include any number of posts 506 that can each support at least two protective barriers 502, thereby allowing an elongated barrier partition to be constructed, such as shown in FIG. 6. As illustrated, an elongated barrier system 600 formed from numerous blast resistant barriers 602 (which may be similar to those described elsewhere herein) that are positioned next to one another, in a straight line and/or with one or more turns. In some embodiments, the blast resistant barriers 602 may be coupled to one another, such as by having posts that may support multiple protective barriers, allowing a number of protective barriers to be daisy chained together to form the elongated barrier system 600. In other embodiments, each blast resistant barrier 602 could be independent and merely placed next to another blast resistant barrier 602 to for the elongated barrier system 600. It will be appreciated that any arrangement of elongated barrier system 600 may be formed using any number of blast resistant barriers 602 described herein.

Figure 7:
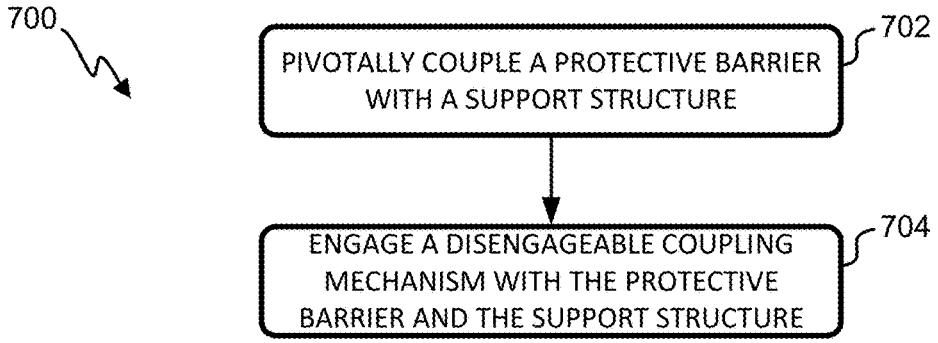
FIG. 7 is a flowchart of a process for using a blast resistant barrier system according to embodiments.

FIG. 7 process 700 for using a blast resistant barrier system. Process 700 may utilize any of the blast resistant barriers described herein and may begin at block 702 by pivotally coupling a first point of a protective barrier with a support structure. This may be done using rotatable pins, rods, hinges, and/or other rotatable coupling mechanisms. At block 704, a disengageable coupling mechanism may be engaged with a second point of protective barrier and the support structure to constrain rotation of the protective barrier relative to the support structure. As just one example, this may involve inserting a shear pin within a first channel defined by the support structure and a second channel defined by the protective barrier to couple the second point of the protective barrier to the support structure, although other disengageable coupling mechanisms may be used as described elsewhere herein. The disengageable coupling mechanism is configured to disengage upon a threshold amount of force being applied to a face of the protective barrier and once the disengageable coupling mechanism disengages, the protective barrier is permitted to rotate relative to the support structure about the first point. In some embodiments, process 700 may include mounting an additional protective barrier to the support structure, such as by mounting an additional protective barrier to an additional coupling position of a post of the support structure as described above.

In some embodiments, process 700 may further include disengaging the disengageable coupling mechanism by application of the threshold amount of force. This may involve an impact force striking the protective barrier of the blast resistant barrier and causing the disengageable coupling mechanism to disengage. In embodiments where the disengageable coupling mechanism includes a shear pin, the disengagement may involve the shear pin shearing as the force is received. At this point, the protective barrier may also pivot about the first point as its rotation is no longer constrained by the disengageable coupling mechanism. After such an impact, the blast resistant barrier may be reset to a protective configuration. For example, the disengageable coupling mechanism may be re-engaged. In embodiments using shear pins, re-engaging the disengageable coupling mechanism may involve replacing the shear pin with a new shear pin. In other embodiments, the disengageable coupling mechanism may remain intact after the impact and merely need to be reconnected, such as in embodiments using magnetic elements, snap-fit connections, and the like.

The methods, systems, and devices discussed above are examples. Some embodiments were described as processes depicted as flow diagrams or block diagrams. Although each may describe the operations as a sequential process, many of the operations can be performed in parallel or concurrently. In addition, the order of the operations may be rearranged. A process may have additional steps not included in the figure.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

What is claimed is:

1. A blast resistant barrier system, comprising: a movable base comprising at least one foot that supports the blast resistant barrier system in an upright position when placed upon a support surface; a support structure extending outward from the base, the support structure comprising: a first pivotal coupling at a first point on an inner portion of the support structure; a second pivotal coupling on an outer portion of the support structure, the outer portion being positioned on an opposite surface of the support structure as the inner portion; a first aperture receiving a first shear pin, the first aperture being formed in the inner portion of the support structure; and a second aperture receiving a second shear pin, the second aperture being formed in the outer portion of the support structure; and a protective barrier that is pivotally coupled with the support structure at a first point of the protective barrier using the first pivotal coupling; and wherein: the first shear pin that is configured to interface with the first aperture couple a second point of the protective barrier to the support structure so as to constrain rotation of the protective barrier relative to the support structure, wherein: the first shear pin is configured to shear upon a threshold amount of force being applied to a face of the protective barrier; and once the first shear pin shears, the protective barrier is permitted to rotate relative to the support structure about the first point; and the second pivotal coupling and the second aperture are configured to couple an additional protective barrier to the support structure in a side-by-side arrangement with the protective barrier.

2. The blast resistant barrier system of claim 1, wherein: the first point is at a first end of the protective barrier and the second point is at a second end of the protective barrier or a medial portion of the protective barrier.

3. The blast resistant barrier system of claim 1, wherein: the support structure comprises two posts that are positioned along opposing edges of the protective barrier.

4. The blast resistant barrier system of claim 3, wherein: the protective barrier is pivotable about one of the two posts.

5. The blast resistant barrier system of claim 1, wherein: the protective barrier is pivotable toward the base.

6. The blast resistant barrier system of claim 1, wherein: the support structure defines a first channel and the protective barrier defines a second channel;

the first channel and the second channel are alignable such that the first shear pin is insertable through both the first channel and the second channel to couple the second point of the protective barrier to the support structure.

7. The blast resistant barrier system of claim 1, wherein: the first shear pin comprises a first portion and a second portion that are separated by a frangible section that has a smaller diameter than each of the first portion and the second portion.

8. A blast resistant barrier system, comprising:

movable base comprising at least one foot that supports the blast resistant barrier system in an upright position when placed upon a support surface;

a support structure extending from the base, the support structure comprising:

a first pivotal coupling at a first point on an inner portion of the support structure;

a second pivotal coupling on an outer portion of the support structure, the outer portion being positioned on an opposite surface of the support structure as the inner portion;

a first disengageable coupling mechanism formed in the inner portion of the support structure; and a second disengageable coupling mechanism formed in the outer portion of the support structure; and a protective barrier that is pivotally coupled with the support structure at a first point of the protective barrier using the first pivotal coupling, wherein:

the first disengageable coupling mechanism couples a second point of the protective barrier to the support structure so as to constrain rotation of the protective barrier relative to the support structure;

the first disengageable coupling mechanism is configured to disengage upon a threshold amount of force being applied to a face of the protective barrier;

once the first disengageable coupling mechanism disengages, the protective barrier is permitted to rotate relative to the support structure about the first point; and the second pivotal coupling and the second disengageable coupling mechanism are configured to couple an additional protective barrier to the support structure in a side-by-side arrangement with the protective barrier.

9. The blast resistant barrier system of claim 8, wherein:

the first disengageable coupling mechanism comprises a shear pin; and disengagement of the shear pin comprises the shear pin shearing upon application of the threshold amount of force.

10. The blast resistant barrier system of claim 8, wherein:

the first disengageable coupling mechanism comprises a spring-loaded ball and detent connector; and disengagement of the spring-loaded ball and detent connector comprises the spring-loaded ball being forced out of the detent by application of the threshold amount of force.

11. The blast resistant barrier system of claim 8, further comprising:

the additional protective barrier that is coupled with the support structure.

12. The blast resistant barrier system of claim 8, wherein:

the support structure is affixed to one or both of a wall structure or a ground structure.

13. The blast resistant barrier system of claim 8, wherein:

the protective barrier is pivotally coupled with the support structure at the first point of the protective barrier using at least one pin that is rotatably received within a first channel defined in the support structure and a second channel defined in the protective barrier.

14. The blast resistant barrier system of claim 8, wherein:

the protective barrier is configured to pivot horizontally about the support structure.

15. A method of using a blast resistant barrier system, comprising:

positioning at least one foot of a movable base of the blast resistant barrier system upon a support surface such that the at least one foot supports the blast resistant barrier system in an upright position;

pivotally coupling a first point of a protective barrier with a support structure that extends from the base using a first pivotal coupling on an inner portion of the support structure; and engaging a first disengageable coupling mechanism of the inner portion of the support structure with a second point of protective barrier and the support structure to constrain rotation of the protective barrier relative to the support structure, wherein:

the first disengageable coupling mechanism is configured to disengage upon a threshold amount of force being applied to a face of the protective barrier;

once the first disengageable coupling mechanism disengages, the protective barrier is permitted to rotate relative to the support structure about the first point;

an outer portion of the support structure comprises a second pivotal coupling and a second disengageable coupling mechanism of an outer portion; and the second pivotal coupling and the second disengageable coupling mechanism are configured to couple an additional protective barrier to the support structure in a side-by-side arrangement with the protective barrier.

16. The method of using a blast resistant barrier system of claim 15, wherein:

engaging the first disengageable coupling mechanism comprises inserting a shear pin within a first channel defined by the support structure and a second channel defined by the protective barrier to couple the second point of the protective barrier to the support structure.

17. The method of using a blast resistant barrier system of claim 15, further comprising:

mounting the additional protective barrier to the support structure.

18. The method of using a blast resistant barrier system of claim 15, further comprising:

disengaging the first disengageable coupling mechanism by application of the threshold amount of force; and pivoting the protective barrier about the first point.

19. The method of using a blast resistant barrier system of claim 18, further comprising:

re-engaging the first disengageable coupling mechanism.

20. The method of using a blast resistant barrier system of claim 19, wherein:

the first disengageable coupling mechanism comprises a shear pin; and re-engaging the first disengageable coupling mechanism comprises replacing the shear pin with a new shear pin.

* * * * *